US006688590B2

(12) United States Patent
Billings et al.

(10) Patent No.: US 6,688,590 B2
(45) Date of Patent: Feb. 10, 2004

(54) DUAL TRAY PRINTER WITH SINGLE DRIVE SHAFT AND DUAL MEDIA PICKS

(75) Inventors: Aaron Wendell Billings, Versailles, KY (US); David Allen Crutchfield, Lexington, KY (US); David Vincent Iorio, Lexington, KY (US); Galen Arthur Rasche, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 249 days.

(21) Appl. No.: 09/732,640

(22) Filed: Dec. 8, 2000

(65) Prior Publication Data

US 2002/0101024 A1 Aug. 1, 2002

(51) Int. Cl.[7] ..... B65H 3/44

(52) U.S. Cl. ..... 271/9.05; 271/9.11; 271/9.12; 271/9.13

(58) Field of Search ..... 271/9.01, 9.05, 271/9.07, 9.11, 9.12, 9.13

(56) References Cited

U.S. PATENT DOCUMENTS 3,933,350 A 1/1976 Mignano
4,053,152 A * 10/1977 Matsumoto ..... 271/118
4,222,557 A * 9/1980 Wu ..... 271/117
4,422,631 A 12/1983 Sugizaki
4,438,915 A 3/1984 Akamatsu et al.
4,674,734 A * 6/1987 Ibuchi ..... 271/117
4,715,593 A 12/1987 Godlewski
4,736,937 A 4/1988 Okuda et al.
5,152,518 A 10/1992 Kikuchi et al.
5,547,179 A 8/1996 Wilcox et al.
5,573,234 A 11/1996 Petocchi
5,727,464 A 3/1998 Bahrami et al.
5,738,453 A 4/1998 Tsuburaya et al.
5,758,249 A 5/1998 Dutton et al.
5,895,040 A 4/1999 Oleksa et al.
5,954,326 A * 9/1999 Gaarder et al. ..... 271/10.11
5,971,390 A 10/1999 Caspar et al.
6,076,821 A 6/2000 Embry et al.
6,089,773 A 7/2000 Bailey et al.
6,135,438 A * 10/2000 Newman et al. ..... 271/9.07

* cited by examiner

*Primary Examiner*—David H. Bollinger
(74) *Attorney, Agent, or Firm*—Garvey, Smith, Nehrbass & Doody, L.L.C.

(57) ABSTRACT

A mechanism (120) which can be used in a printer (110), for example, for selectively moving sheets from first and second sheet stacks, including a rotating shaft (123), a mechanism for causing the rotating shaft (123) to rotate in first and second directions, and first and second media picks (121, 122). Rotation of the rotating shaft (123) in the first direction causes the first media pick (121) to move a sheet from the first sheet stack (51) and rotation of the rotating shaft (123) in the second direction causes the second media pick (122) to move a sheet from the second sheet stack (52).

28 Claims, 5 Drawing Sheets

DUAL TRAY PRINTER WITH SINGLE DRIVE SHAFT AND DUAL MEDIA PICKS

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to printers. More particularly, the present invention relates to printers having at least two media sources.

2. General Background of the Invention

Lexmark currently makes various types of ink jet printers (such as Lexmark® Model Z51, Lexmark® Model Z31, and Lexmark® Model Z11) which all contain similar media feeding mechanisms. These current mechanisms pick media from the top of the stack of media and feed it into the print area. Each of these mechanisms has one media pick roller and one rotating shaft to drive the picking mechanism.

The following U.S. Patents are incorporated herein by reference: U.S. Pat. Nos.: 3,933,350; 4,422,631; 4,438,915; 4,715,593; 4,736,937; 5,152,518; 5,547,179; 5,573,234; 5,727,464; 5,738,453; 5,758,249; 5,895,040; 5,971,390; 6,076,821; and 6,089,773.

BRIEF SUMMARY OF THE INVENTION

The present invention comprises a dual tray media feeding apparatus for a printer, such as an ink jet printer.

One embodiment of the present invention equips the printer with a unique, low cost, compact dual tray system that uses one drive shaft for two media pick rollers with minimal change to Lexmark's current one tray design.

Preferably, the present invention combines current Lexmark media feeding technology and a new sheet feeder with bottom sheet picking mechanism to create a new dual-tray system. This dual-tray system is accomplished using one drive shaft for two media pick rollers with minimal change to the current Lexmark media feeding design.

Preferably, the present invention equips the printer with the ability to pick media from the bottom of a stack of media without changing the slanted orientation of current Lexmark media trays.

The present invention preferably includes a sheet feeder with a bottom sheet picking mechanism. The sheet feeder with a bottom sheet picking mechanism picks a sheet of media from underneath a stack of media and feeds it into the print area of the printer. The present invention preferably comprises a dual media tray system that uses the same drive shaft for both media pick rollers.

It is an object of the present invention to provide a unique, low cost, compact dual tray system that uses one drive shaft for two media pick rollers.

It is another object of the present invention to provide a printer including a unique, low cost, compact dual tray system that uses one drive shaft for two media pick rollers.

A further object of the present invention is to provide a printer with the ability to pick media from the bottom of a stack of media without changing the slanted orientation of current Lexmark media trays.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

The present invention combines current Lexmark media feeding technology with a new sheet feeder to create a new design for dual media feeding. Preferably, at least one of the trays uses bottom sheet picking mechanism.

Figure 1:
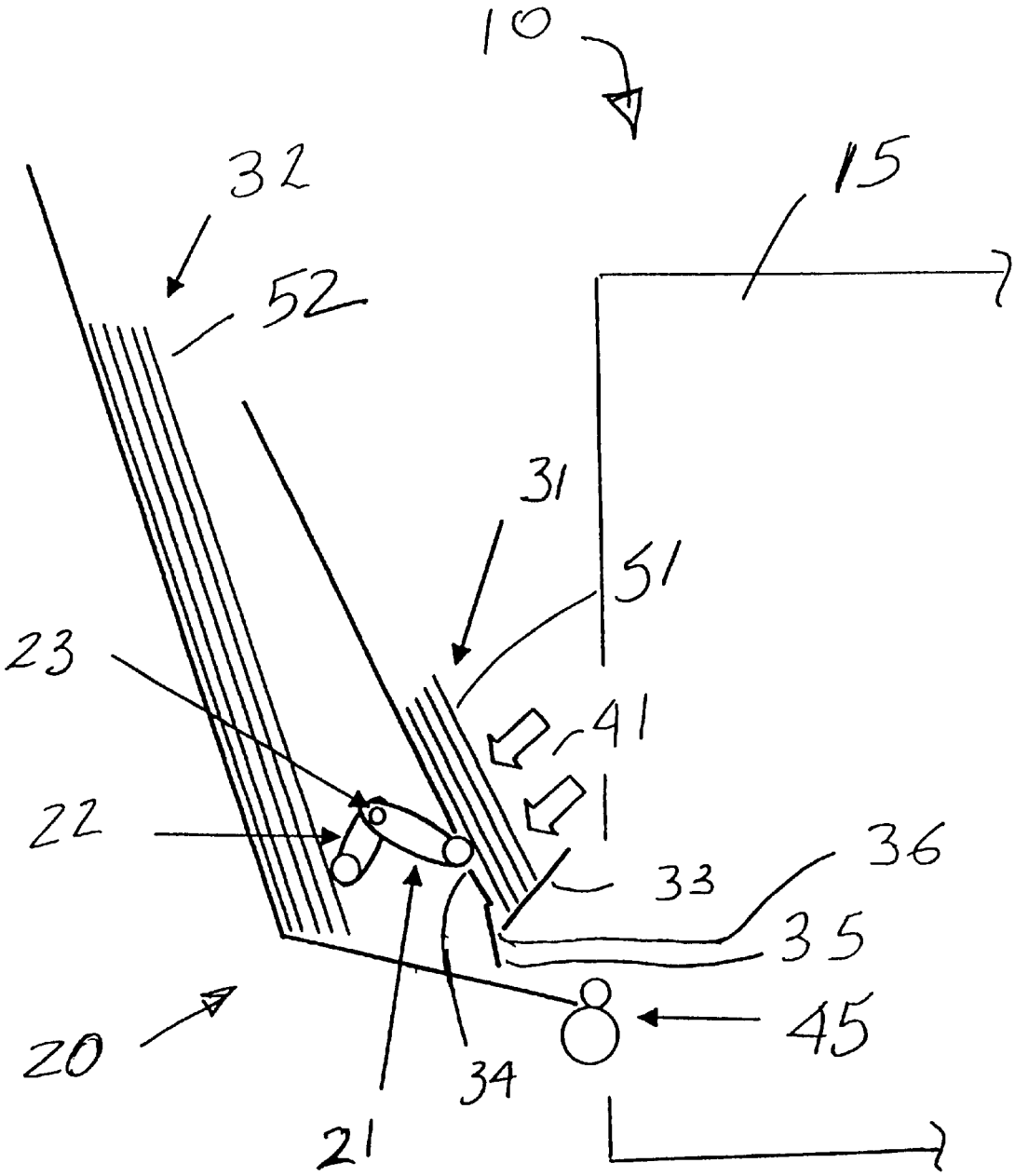
FIG. 1 is a schematic side view of a first embodiment of the apparatus of the present invention.

FIG. 1 shows a first embodiment of the present invention, printer 10. Printer 10 includes a vertical media tray 32 similar to the current media trays used in Lexmark products (such as Lexmark® Model Z51, Lexmark® Model Z31, and Lexmark® Model Z11). Printer 10 also contains a media pick roller/auto compensator 21 and a media tray 31. This tray 31 has a slot 34 that allows the media pick roller 21 to contact the media 51 from the bottom. It also contains a lower exit slot 36 and a media guide 35 at the bottom of the tray 31 insuring that the media 51 is guided into the feed area 45 of printer 10. The floor 33 of the tray 31 is angled in such a way that media 51 rests on the floor 33 but can be easily guided into the lower exit slot 36. In front of the new media tray 31, a pressure system 41 is used to insure that the media 51 is in constant contact with the forward facing media pick roller 21 and that the bottom edge of the media 51 is directed into the lower slot 36.

The new dual media tray design discussed here and shown in FIG. 1 adds the pick roller/auto compensator arm 21 from a sheet feeder with bottom sheet picking mechanism to the original rotating shaft 23 of the current media feeder which also contains a pick roller/auto compensator 22. The new picking mechanism (pick 21) faces the opposite direction of the original picking mechanism (pick 22) while relying on the same rotating shaft 23 for operation. Thus, one picking mechanism is facing to the rear of the printer 10 while the other is facing to the front. The picking mechanisms are clutched in such a way that only one operates for a certain direction of rotation. For example, counter clockwise rotation of the rotating shaft 23 (driven by an electric stepper motor, for example) operates pick 21, and clockwise rotation of the rotating shaft operates pick 22. Both pick 21 and pick 22 apply pressure to the surface of the media 51, 52. The sheet feeder with bottom sheet picking mechanism media tray 31 is added in front of the forward facing picking mechanism tray 32. FIG. 1 shows two different types of media 51, 52 in the two media trays 31, 32. The type of media can vary, depending on user preference, and can include, for example, 8½ inch×11 inch paper, envelopes, A4 paper, photographic paper.

Figure 2:
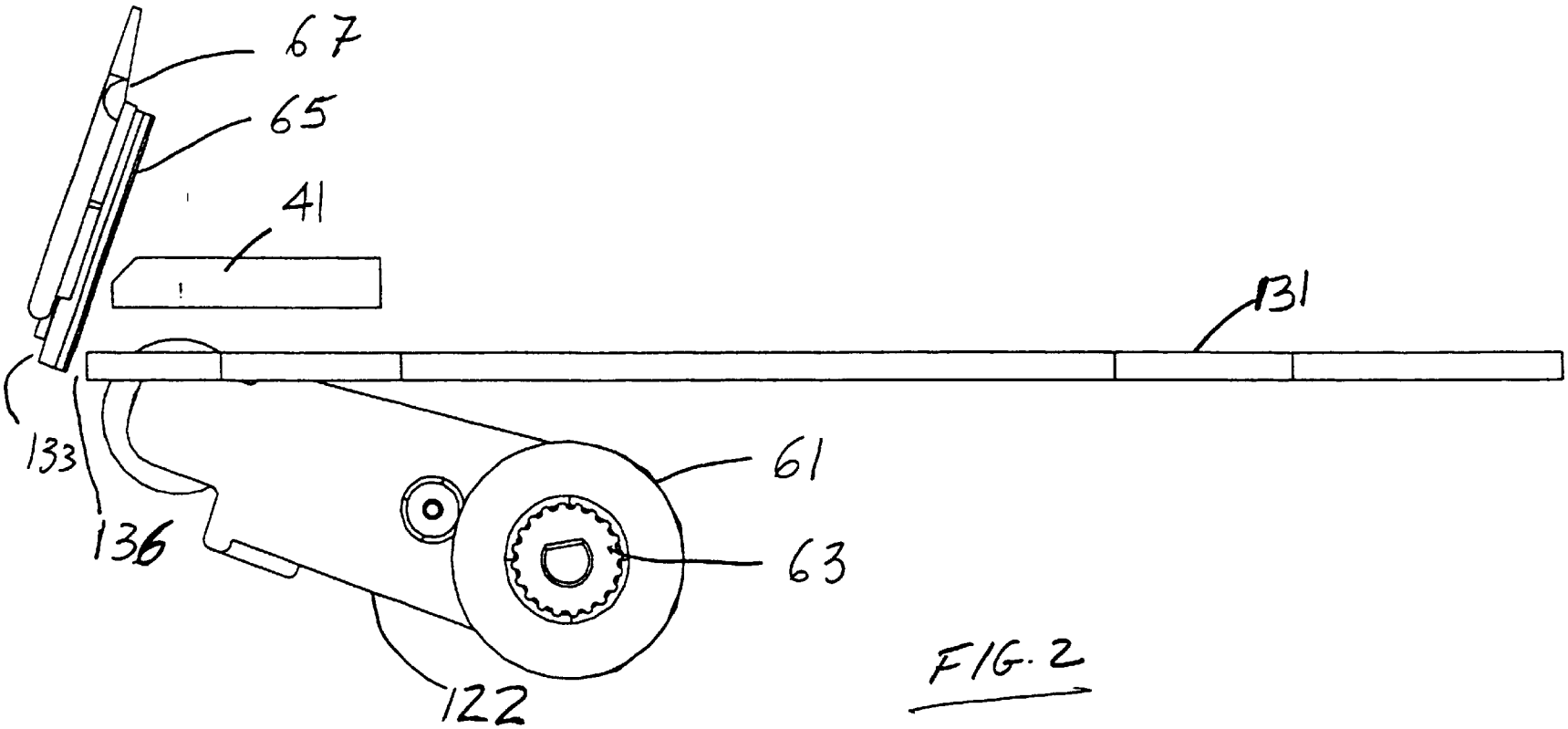
FIG. 2 is a side view of the bottom pick paper tray of the preferred embodiment of the apparatus of the present invention.
Figure 3:
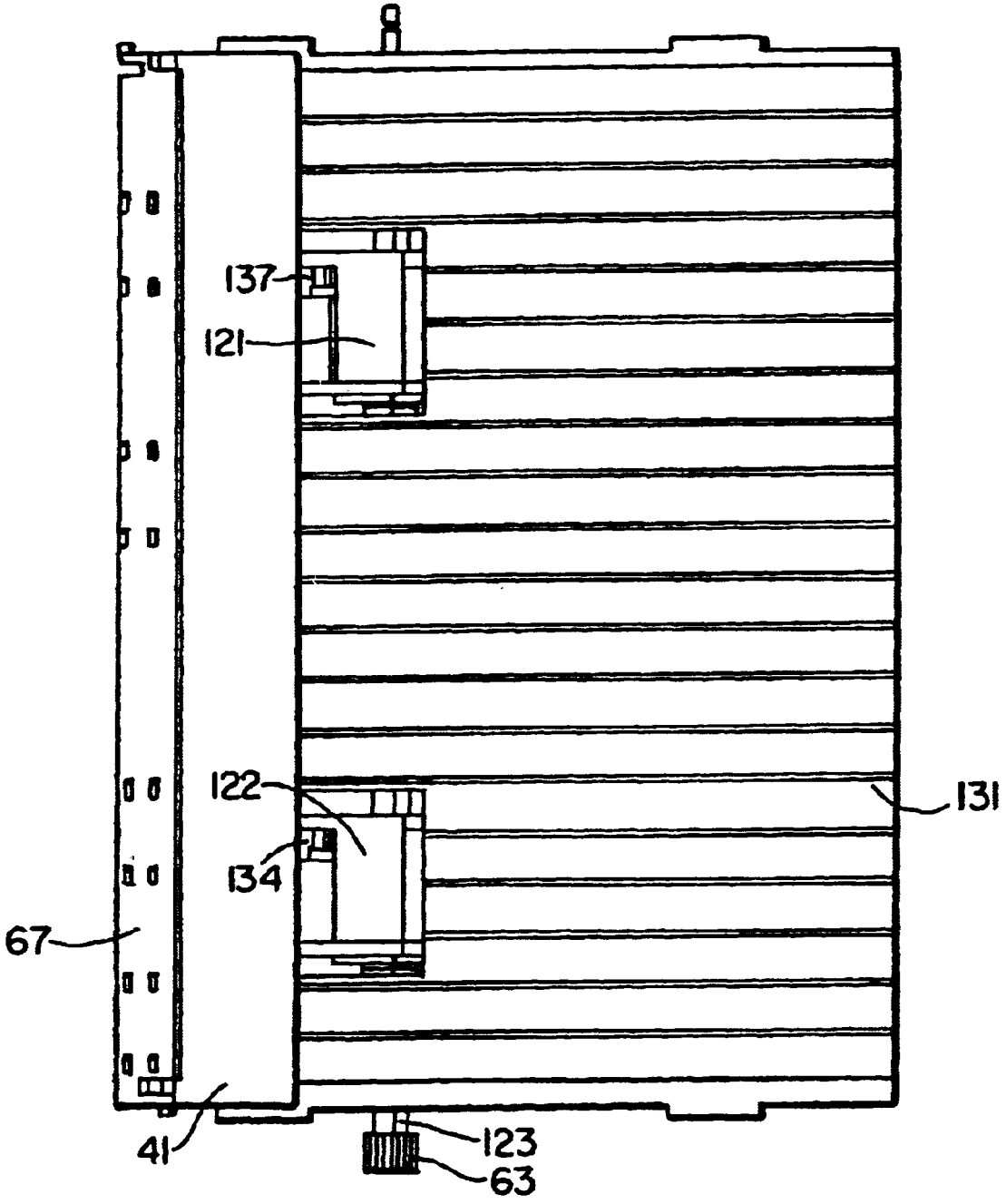
FIG. 3 is a top view of the bottom sheet picking media tray of the preferred embodiment of the apparatus of the present invention (without media in the tray)
Figure 4:
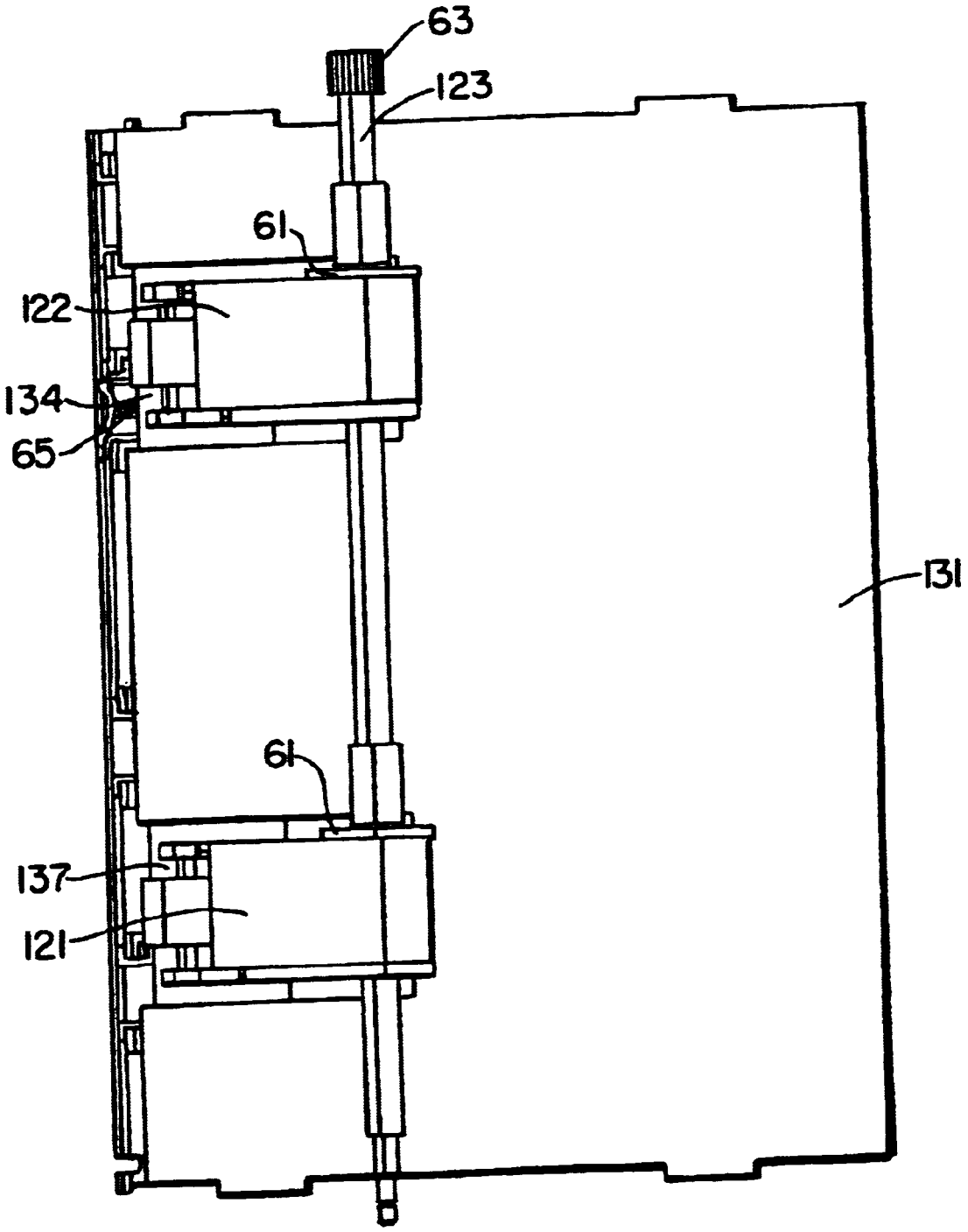
FIG. 4 is a bottom view of the bottom sheet picking media tray of the preferred embodiment of the apparatus of the present invention.
Figure 5:
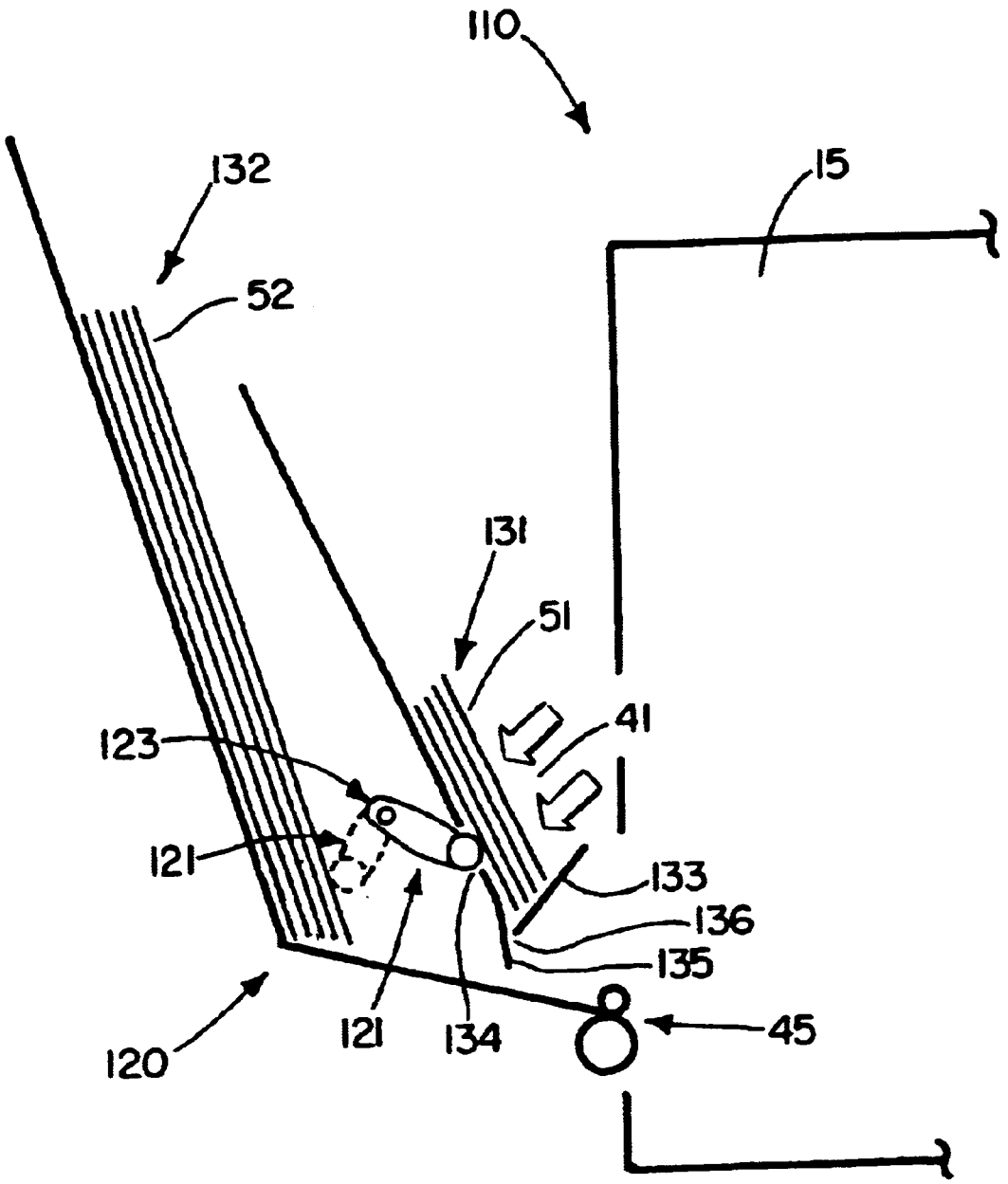
FIG. 5 is a schematic side view of the preferred embodiment of the apparatus of the present invention.

In FIG. 1 a dual-tray system is depicted to contain a current Lexmark media feeding design. Attached to the same shaft 23 that engages the pick 22 of the current design is another pick 21 facing forward through a slot 34 so that paper can be picked from the bottom of a second stack of media 51. The idea was that the shaft 23 would turn in one direction to pick media from one stack of media then turn in the other direction to pick media from the opposite stack of media. After putting effort into implementing the preferred embodiment it was found that picking from the bottom of the stack of media was not trivial. To accomplish this task it was helpful to add an extra pick to the bottom feeding portion of the dual system to build enough force to pick the media from the bottom while keeping the media aligned. To avoid extra cost it was thought that instead of having separate picks for each stack of media, a system would be implemented that contained two picks that would rotate uniformly with the changing direction of the pick shaft to engage the correct media tray. This system is shown in FIGS. 2–4, and as part of printer 110 in FIG. 5.

Printer 110 includes tray 131 and tray 132. Printer 110 includes a drive shaft 123 operatively coupled to picks 121 and 122. Attached to drive shaft 123 is a pick shaft gear 63, which itself is attached to a belt or other drive means controlled by printer 110 to move shaft 123 in clockwise and counterclockwise directions.

Tray 131 preferably includes a paper buckler 65 to separate the individual sheets of paper upon picking. Tray 131 also preferably includes slots 134 and 137, a pressure system 41, and a paper dam 67.

There is preferably a friction washer 61 against each pick 121, 122 on the driving shaft 123 to ensure that the picks 121, 122 rotate to the desired location upon reversal of the shaft direction.

When shaft 123 rotates in a first direction, picks 121 and 122 move to tray 131 and pick media from tray 131 through slots 134 and 137, respectively. Media travels out of tray 131 through lower exit slot 136 and onto media guide 135, which directs media to feed area 45 of printer 110.

When shaft 123 reverses direction, picks 121 and 122 move to tray 132 (see FIG. 5) and pick media from tray 132.

Media in trays 131 and 132 can be the same as media in trays 31 and 32.

Multiple media-tray (more than 2 trays) technology can be easily based on this new dual-tray system. However two separate conditions need to be discussed. If N is the number of trays desired and N is odd, then N/2 dual trays and one existing technology single tray would need to be added to the printer; if N is even, then only N/2 dual trays would need to be added to the printer. Thus any number of the above-discussed dual media trays along with existing technology single trays for odd numbers could be added to the printer as long as the distance from the pick roll to the nip is not longer than the media (or other means are provided to move the media to the nip).

This invention preferably uses the same type of media pick used by Lexmark printers, but changes the pick's orientation and media feed path to create a mechanism capable of feeding media from the bottom of the stack. Picking from the bottom of the stack is helpful to avoid damaging the print side of the media. It also enables different physical layouts of the printer from those using top picking mechanisms.

One embodiment of the present invention utilizes Lexmark's current feeding technology to create a bottom feeding mechanism. The orientation of the media, whether vertical or horizontal, is not important for the system described to function.

Appropriate means (not shown, but which will be apparent to those skilled in this art) are used to select the media tray from which media are to be drawn.

Aside from the multiple-tray aspect, printers 10 and 110 can be the same as current Lexmark printers (such as Lexmark® Model Z51, Lexmark® Model Z31, and Lexmark® Model Z11).

Dual tray systems 20, 120 could be used in equipment other than printers; for example, they could be used in photocopy machines or fax machines.

Parts List

The following is a list of parts and materials suitable for use in the present invention:

10 printer including dual tray system 20 of a first embodiment of the present invention
15 portion of printer 10 in addition to dual tray system 20 (which can be, for example, the same as the corresponding portion of Lexmark® Model Z51, Lexmark® Model Z31, or Lexmark® Model Z11 printers) (shown schematically in FIG. 1)
20 dual tray system with single drive shaft 23 and dual media picks 21 and 22 of the first embodiment of the present invention
21 first media pick roller/auto compensator (such as currently used on Lexmark® Model Z51, Lexmark® Model Z31, or Lexmark® Model Z11 printers)
22 second media pick roller/auto compensator (such as currently used on Lexmark® Model Z51, Lexmark® Model Z31, or Lexmark® Model Z11 printers)
23 drive shaft (made of fiber fill plastic, for example)
31 first media tray (made of ABS plastic, for example)
32 second media tray—forward facing picking mechanism tray (such as a vertical tray similar to the current media trays used in Lexmark products—e.g., Lexmark® Model Z51, Lexmark® Model Z31, or Lexmark® Model Z11 printers) (made of ABS plastic, for example)
33 floor of tray 31
34 slot of media tray 31
35 media guide at the bottom of the tray 31
36 lower exit slot of tray 31
41 pressure system (such as a paper backstop made of ABS plastic)
45 feed area of printer 10
51 media in tray 31 (such as size #10 envelopes)
52 media in tray 32 (such as 8.5"×11" paper)
61 friction washer
63 pick shaft gear
65 paper buckler
67 paper dam
110 printer including dual tray system 120 of the preferred embodiment of the present invention
120 dual tray system with single drive shaft 123 and dual media picks 121 and 122 of the preferred embodiment of the present invention
121 first media pick roller/auto compensator (such as currently used on Lexmark® Model Z51, Lexmark® Model Z31, or Lexmark® Model Z11 printers) of tray 131

122 second media pick roller/auto compensator (such as currently used on Lexmark® Model Z51, Lexmark® Model Z31, or Lexmark® Model Z11 printers)of tray 131
123 drive shaft (made of fiber fill plastic, for example)
131 first media tray (made of ABS plastic, for example) of printer 110
132 second media tray—forward facing picking mechanism tray (such as a vertical tray similar to the current media trays used in Lexmark products—e.g., Lexmark® Model Z51, Lexmark® Model Z31, or Lexmark® Model Z11 printers) of printer 110 (made of ABS plastic, for example)
133 floor of tray 131
134 pick slot of media tray 131
135 media guide at the bottom of the tray 131
136 lower exit slot of tray 131
137 pick slot of media tray 131

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

What is claimed is:

1. A printer apparatus that includes a mechanism for selectively moving sheets from first and second sheet stacks, including:

a) a printer that has a first sheet stack and a second sheet stack that is spaced from the first sheet stack, each sheet stack having a top portion and a bottom portion;

b) a rotating shaft on the printer next to the bottom of at least one of the sheet stacks;

c) a motor for causing the rotating shaft to rotate in a first direction and in a second direction;

d) a first media pick for moving a sheet from the first sheet stack, the first media pick being mounted on the rotating shaft;

e) a second media pick for moving a sheet from the second sheet stack, the second media pick being mounted on the rotating shaft, wherein:

f) rotation of the rotating shaft in the first direction causes the first media pick to move a sheet from the first sheet stack; and g) rotation of the rotating shaft in the second direction causes the second media pick to move a sheet from the second sheet stack.

2. The apparatus of claim 1, wherein each sheet stack has a bottom and the media picks move sheets from the bottom of at least one of the stacks.

3. The apparatus of claim 2, further comprising a pressure system for pressing media into contact with the first media pick.

4. A printer including the apparatus of claim 1.

5. An ink jet printer including the apparatus of claim 1.

6. An ink jet printer including the apparatus of claim 1.

7. An apparatus for selectively moving sheets from first and second sheet stacks, including:

a) a rotating shaft;

b) a motor for causing the rotating shaft to rotate in a first direction and in a second direction;

c) a first media pick for moving a sheet from the first sheet stack, the first media pick being operatively connected to the rotating shaft;

d) a second media pick for moving a sheet from the second sheet stack, the second media pick being operatively connected to the rotating shaft, wherein:

e) rotation of the rotating shaft in the first direction causes the first media pick to move a sheet from the first sheet stack;

f) rotation of the rotating shaft in the second direction causes the second media pick to move a sheet from the second sheet stack; and g) wherein there are multiples of the apparatus.

8. A printer apparatus comprising:

a) a printer that has a first sheet stack and a second sheet stack that is spaced from the first sheet stack, each sheet stack having a top portion and a bottom portion;

b) a rotating shaft mounted in between the sheet stacks;

c) a motor for causing the rotating shaft to rotate in a first direction and in a second direction;

d) a pair of media picks that are mounted on the rotating shaft, in between the sheet stacks;

e) wherein rotation of the rotating shaft in the first direction causes at least one of the media picks to move a sheet from the first sheet stack, and f) rotation of the rotating shaft in the second direction causes at least one of the media picks to move a sheet from the second sheet stack.

9. The apparatus of claim 8, wherein each sheet stack has a bottom and the media picks move sheets from the bottom of at least one of the stacks.

10. A printer including the apparatus of claim 8.

11. An ink jet printer including the apparatus of claim 8.

12. An apparatus for selectively moving sheets from first and second sheet stacks, including:

a) a rotating shaft;

b) a motor for causing the rotating shaft to rotate in a first direction and in a second direction;

c) a first media pick for moving a sheet from the first sheet stack, the first media pick being operatively connected to the rotating shaft;

d) a second media pick for moving a sheet from the second sheet stack, the second media pick being operatively connected to the rotating shaft, wherein rotation of the rotating shaft in the first direction causes the first media pick to move a sheet from the first sheet stack, and rotation of the rotating shaft in the second direction causes the second media pick to move a sheet from the second sheet stack; and e) a pressure system for pressing media into contact with the first media pick.

13. An apparatus for selectively moving sheets from first and second sheet stacks, including:

a) a rotating shaft;

b) a motor for causing the rotating shaft to rotate in a first direction and in a second direction;

c) a first media pick for moving a sheet from the first sheet stack, the first media pick being operatively connected to the, rotating shaft;

d) a second media pick for moving a sheet from the second sheet stack, the second media pick being operatively connected to the rotating shaft, wherein:

e) rotation of the rotating shaft in the first direction causes the first media pick to move a sheet from the first sheet stack;

f) rotation of the rotating shaft in the second direction causes the second media pick to move a sheet from the second sheet stack;

g) a second media pick, the second media pick being operatively connected to the rotating shaft, wherein:

h) rotation of the rotating shaft in the first direction causes the first media pick and the second media pick to move a sheet from the first sheet stack; and i) rotation of the rotating shaft in the second direction causes the first media pick and the second media pick to move a sheet from the second sheet stack.

14. The apparatus of claim 13, wherein the first media pick and the second media pick are laterally spaced apart.

15. A printer apparatus, comprising:

a) a printer that has a first sheet stack and a second sheet stack that is spaced from the first sheet stack, each sheet stack having a top portion and a bottom portion;

b) a rotating shaft on the printer in between the first and second sheet stacks;

c) a motor for causing the rotating shaft to rotate in a first direction and in a second direction;

d) a first media pick, the first media pick being mounted on the rotating shaft in between the first and second sheet stacks;

e) a second media pick, the second media pick being operatively connected to the rotating shaft, wherein:

f) rotation of the rotating shaft in the first direction causes a sheet to be moved from the first sheet stack, and g) rotation of the rotating shaft in the second direction causes a sheet to be moved from the second sheet stack.

16. The apparatus of claim 15, wherein each sheet stack has a bottom and the media picks move sheets from the bottom of at least one of the stacks.

17. The apparatus of claim 15, further comprising a pressure system for pressing media into contact with the first media pick.

18. The apparatus of claim 15, wherein the first media pick and the second media pick are laterally spaced apart.

19. A printer including the apparatus of claim 15.

20. An ink jet printer including the apparatus of claim 15.

21. An apparatus for selectively moving sheets from first and second sheet stacks, including:

a) a rotating shaft;

b) a motor for causing the rotating shaft to rotate in a first direction and in a second direction;

c) a first media pick, the first media pick being operatively connected to the rotating shaft;

d) a second media pick, the second media pick being operatively connected to the rotating shaft, wherein:

e) rotation of the rotating shaft in the first direction causes a sheet to be moved from the first sheet stack;

f) rotation of the rotating shaft in the second direction causes a sheet to be moved from the second sheet stack; and g) wherein there re multiples of the apparatus.

22. A printer sheet feed apparatus for selectively moving sheets from first and second sheet stacks, including:

a) a chassis that has first and second sheet stack holders, each sheet stack holder having a bottom portion;

b) a rotating shaft supported by the chassis at a position in between the bottom portions of the sheet stack holders;

c) a motor for causing the rotating shaft to rotate in a first direction and in a second direction;

d) a plurality of media picks mounted on the rotating shaft in between the sheet stack holders and near the bottom of at least one of the sheet stack holders;

e) wherein rotation of the rotating shaft in the first direction causes a sheet to be moved from the first sheet stack holder; and f) rotation of the rotating shaft in the second direction causes a sheet to be moved from the second sheet stack holder.

23. The apparatus of claim 22, wherein the media picks move sheets downwardly from the bottom of at least one of the stacks.

24. The apparatus of claim 22, further comprising a pressure system for pressing media into contact with the first media pick.

25. The apparatus of claim 22, wherein the media picks are laterally spaced apart.

26. A printer sheet feed apparatus for selectively moving sheets from first and second sheet stack holders, comprising:

a) a chassis supporting first and second sheet stack holders, each holder having a top portion and a bottom portion;

b) a rotating shaft supported by the chassis at a position in between the sheet stack holders and next to the bottom portion of a sheet stack holder;

c) a motor for causing the rotating shaft to rotate in a first direction and in a second direction;

d) a first media pick positioned in between the bottom portions of the sheet stack holders for moving a sheet downwardly from the first sheet stack holder, the first media pick rotating shaft at a position in between the sheet stack holders;

e) a second media pick for moving a sheet downwardly from the second sheet stack holder, the second media pick driven by the rotating shaft at a position in between the sheet stack holders;

f) wherein rotation of the rotating shaft in the first direction causes the first media pick to move a sheet from the first sheet stack, and g) rotation of the rotating shaft in the second direction causes the second media pick to move a sheet from the second sheet stack.

27. The apparatus of claim 26, wherein each sheet stack has a bottom and the media picks move sheets from the bottom of at least one of the stacks.

28. The apparatus of claim 26, further comprising a pressure system for pressing media into contact with the first media pick.

* * * * *